United States Patent [19]

Wasko

[11] Patent Number: 4,684,559

[45] Date of Patent: Aug. 4, 1987

[54] HAND IMPLEMENT SUPPORT APPARATUS

[76] Inventor: Andrew J. Wasko, Box 100, R.D. #1, Loretto, Pa. 15940

[21] Appl. No.: 912,383

[22] Filed: Sep. 26, 1986

[51] Int. Cl.[4] ..... B32B 3/06

[52] U.S. Cl. ..... 428/100; 2/DIG. 6; 16/DIG. 12; 273/75; 273/81 R; 273/81 D; 273/DIG. 30; 273/165; 273/166; 428/192

[58] Field of Search ..... 428/100, 192; 273/75, 273/81 R, 81 D, 165, 166, DIG. 30; 2/DIG. 6; 16/DIG. 12

[56] References Cited

U.S. PATENT DOCUMENTS

| | | | |
|---|---|---|---|
| 2,780,464 | 2/1957 | Ashley | 273/165 |
| 3,000,384 | 9/1961 | Piers | 2/DIG. 6 |
| 4,252,344 | 2/1981 | Larsen | 2/DIG. 6 |

*Primary Examiner*—Alexander S. Thomas
*Attorney, Agent, or Firm*—Carothers & Carothers

[57] ABSTRACT

An elongated wrap-around flexible support apparatus for supporting the handle of a hand implement with respect to the wrist and hand of a user.

9 Claims, 5 Drawing Figures

HAND IMPLEMENT SUPPORT APPARATUS

BACKGROUND OF THE INVENTION

In the various mechanical arts there are known a wide range of hand implements comprising an elongated structure having a handle end which is formed to be grasped by a user, and a working end formed to strike an object upon manual swinging of the implement by the user.

For example, the well known carpenter's hammer comprising a forged steel head mounted on one end of an elongated wooden handle such that the user grasps the opposite end of the handle and swings the hammer to repeatedly impact the head of a nail or spike to thereby drive the nail as desired. Other such implements include axes, sledge hammers, and the like.

Many implements designed for use in athletic endeavors employ the entirely similar concept of an elongated structure having a working end which is adapted to strike an object, and a handle end which is adapted to be gripped by a user. For example, a racket for use in the game of tennis comprises a hoop-like racket head that is strung with tensioned strings and utilized for striking a tennis ball, and a handle end generally of elongated cylindrical form and wrapped with such suitable pliable material as leather to provide a firm, comfortable and non-slipping grip for the user. Other sports or athletic implements of similar structure in general include squash, racketball, badminton and paddle tennis and deck tennis rackets.

In general, the object of use in any of such implements is to permit a user to strike an object located at some distance from the user's hand to impart a high magnitude of energy, with a high degree of reliable control, to the object being struck.

Sports rackets in particular have evolved in design to permit a user to impart greater force to an object such as a tennis ball by permitting greater racket head speed that could be imparted with prior racket designs. This, however, is not the only, and probably not the most important design criteria for rackets such as tennis rackets. The success of a tennis player in using any given racket depends far more on control of the racket than on maximizing racket hand speed. The wide variety of shots which a tennis player must be able to execute entails wide variations on the application of both power and spin to control the trajectory of the ball with minimum player fatigue resulting. In addition, the player must be able to execute such a variety of shots on both the forehand and backhand side, each of which entails use of entirely different sets of muscles to achieve the objective. Still furthermore, because the player must cover the entire court, perhaps often executing desperation shots or off balance shots, the racket design must facilitate easy manuvering to a variety of orientations including but not limited to frequent repositioning of the racket for different grips by the user for forehand and backhand shots.

The evolution of tennis racket design has seen a wide variety of innovations in racket head size and ocnfiguration, racket weight distribution, frame construction, and the like, all intended to improve player consistency and control by reducing the effects of the impact between the racket head and the ball upon the user's grip. With the elongated handle of the tennis racket, the head of the tennis racket striking the ball not only propels the ball but in addition generates a reaction force which must be supported by the user's body structure through his hand, wrist and arm. The reaction loads must be resisted by the user's hand, wrist and arm if he is to maintain control. It is only with great difficulty and endless training that a player can, without assistance, exercise sufficient control over racket motion to strike the ball with reliable control while maintaining a sufficiently firm grip and wrist to resist all reaction forces generated by the impact. It is said that in tennis everything depends on a firm wrist. This however does not mean an absolutely rigid wrist as the wrist must also be flexible to permit the manuverability necessary for control and to execute the more difficult shots.

BRIEF SUMMARY OF THE INVENTION

The present invention contemplates a flexible, resiliently elastic support structure which is utilized to assist in supporting an implement handle such as a tennis racket handle with respect to the wrist and hand of a user in a manner to permit relative movement of the implement handle with respect to the user's hand while at the same time providing considerable support to absorb the reaction forces generated by the impact of the implement head with the object being struck.

To this end, there is provided by the instant invention a novel wrist wrap accessory for use particularly in racket sports such as tennis to securely yet flexibly retain the racket handle with respect to the wrist of the user while at the same time providing support to assist the user in maintaining a firm wrist without binding or locking the wrist in a fixed alignment with respect to the forearm. The accessory of this invention comprises generally an elongated, resiliently flexible band of woven or knitted fabric having an elasticized loop adjacent one end thereof which is of a size to receive and firmly grip the butt end of a racket handle and having a continuously adjustable circumferential fastener such as a Velcro TM brand fastener strip or band adjacent the opposite end thereof. The accessory thus may be installed with the loop end thereof secured about the butt end of the racket handle, and the remaining length of the accessory band wrapped in tensioned fashion repeatedly about the wrist (and/or adjacent hand and arm portions of the user) and also about the racket handle itself, and secured by the fastener strip. The wrapped band thus supplements the grip of the user on the racket handle by providing additional support for the racket with respect to the wrist while also imparting supplemental firmness to the wrist to absorb a portion of the reaction forces encountered in striking the tennis ball or other object. The flexibility of the accessory, even when tension wrapped about the user's wrist, permits flexing of the wrist within a range of movement sufficient to accommodate all desired adjustments of wrist position with respect to the forearm as well as adjustments of the hand grip on the racket handle. The comparative stiffness of the fastener strip limits the range of relative wrist movement to a greater or lesser degree, depending upon how tightly the resiliently flexible band is wrapped, as well as how tightly the fastener band is secured about the turns of resilient material.

The invention also comtemplates a novel and improved method of maintaining manual control of a tennis racket in play, or of any other similar article in use.

The invention will be more clearly understood upon consideration of the following detailed description and the accompanying drawings in which.

Figure 1:
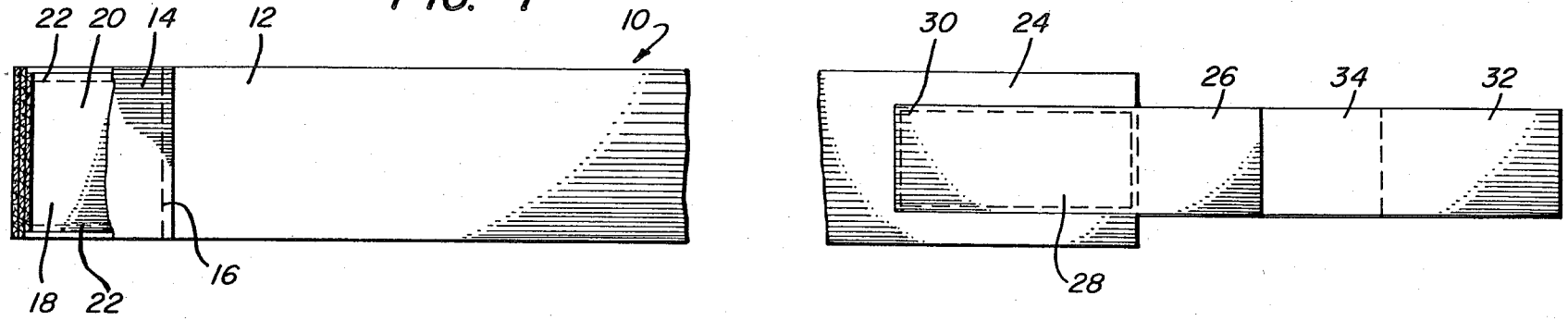
FIG. 1 is a plan view of an accessory according to the instant invention.

There is generally indicated at 10 in FIG. 1 an accessory according to the present invention and comprising an elongated webb of woven or knitted fabric 12 having properties of both lateral and longitudinal resilient flexibility which permits the fabric of webb 12 to be stretched and deformed both longitudinally and transversely. The webb 12 preferably is elasticized such that it will maintain light tension in its deformed state, and upon release of the tension forces will resile to its undeformed state. One suitable material for use in constructing the webb 12 may be, for example, an Ace TM brand sports bandage.

Figure 2:
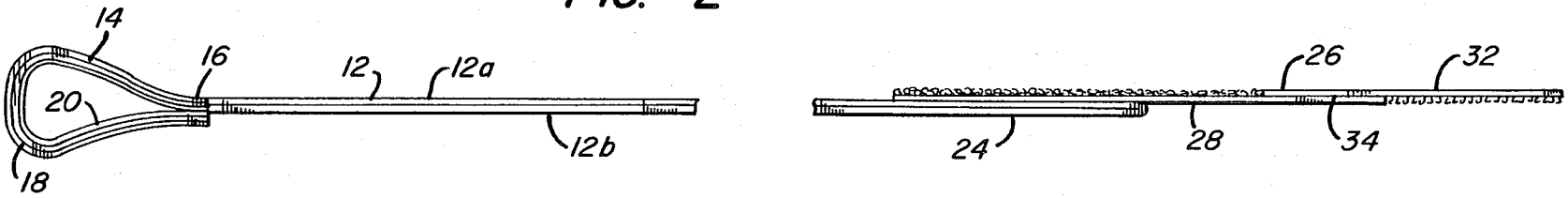
FIG. 2 is a side elevation of the accessory of FIG. 1.
Figure 3:
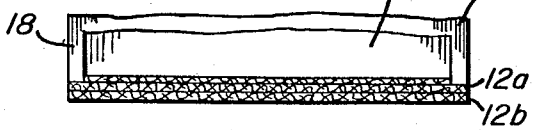
FIG. 3 is a section taken on line III—III of FIG. 2.

As shown in FIG. 2, the webb 12 preferably is comprised of overlapped lengths of material 12*a* and 12*b*, or indeed a single length of such material folded back upon itself at its center to form a double thickness webb 12. In addition, the material may be preferably a self-adhering or "sticky back" sports bandage material that is folded over upon itself such that the self-adhering sides of the two adjacent lengths of material are placed in confronting relationship. The double thickness webb of material thus is maintained substantially as a two layer laminate adhered by the adhesive quality of the confronting faces.

The accessory 10 may have such dimensions as for example a length of 42 inches overall and a width of 3 inches overall. For an accessory of these dimensions, approximately 30 inches of the overall length will be the webb of resiliently flexible material 12 with the remaining 12 inches being a length of friction fastener or similar material as described hereinbelow.

One end portion 14 of the webb 12 is folded back upon itself and stitched as at 16 to form a loop 18 of a size to snuggly receive the butt end of a racket handle (not shown). A loop of elastic material 20, for example, a length of rubberized elastic preferably offering substantially greater tension per unit of the elongation than the material of webb 12, is maintained within loop 18 as by having the ends thereof captured in seam 16, and by perimeter stitching 22 for example.

The elasticized material 20 forms a loop sufficiently smaller than the smallest anticipated racket handle butt end that the loop 18 must be stretched significantly to pass over the butt end of the racket handle. Thus, the loop 18 is adapted to be retained with respect to the butt end of a racket handle with a firm grip thereon which improves the user's grip on the racket handle in the manner described hereinbelow without unduly restricting racket handle movement.

The opposite end portion 24 of webb 12 is provided with an elongated, continuously adjustable fastener band 26 which is utilized to secure the accessory 10 in use, as described hereinbelow. Fastener band 26 preferably comprises a length of friction fastener 28 (e.g. a Velcro TM brand fastener strip) secured to end portion 24 of webb 12 as by perimeter stitching 30. A second length of friction fastener 32 (e.g. the mating portion of a Velcro TM brand fastener strip) overlaps the free end of fastener strip portion 28 as at 34 with the respective fastening surfaces of fastener strips 28 and 32 in confronting relationship and therefore firmly but releasably secured together.

Figure 4:
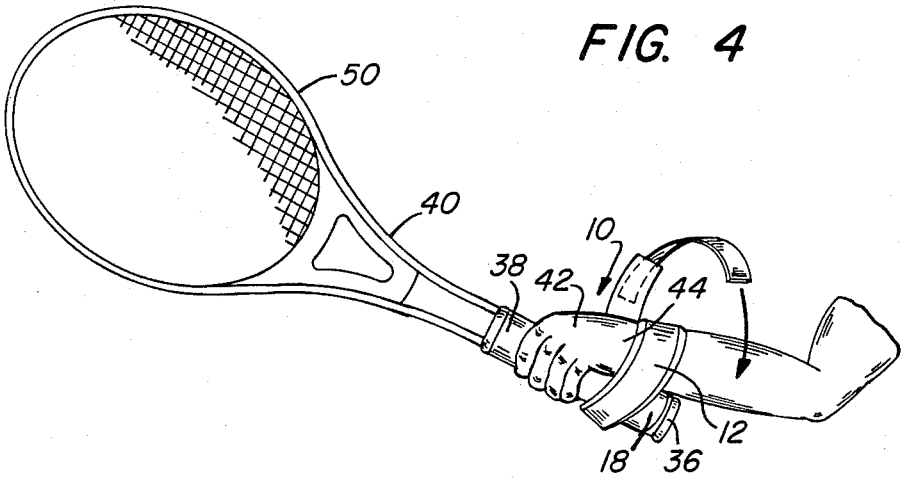
FIG. 4 is a pictorial illustration of the accessory of FIGS. 1 through 3 in use, and the method of the present invention.
Figure 5:
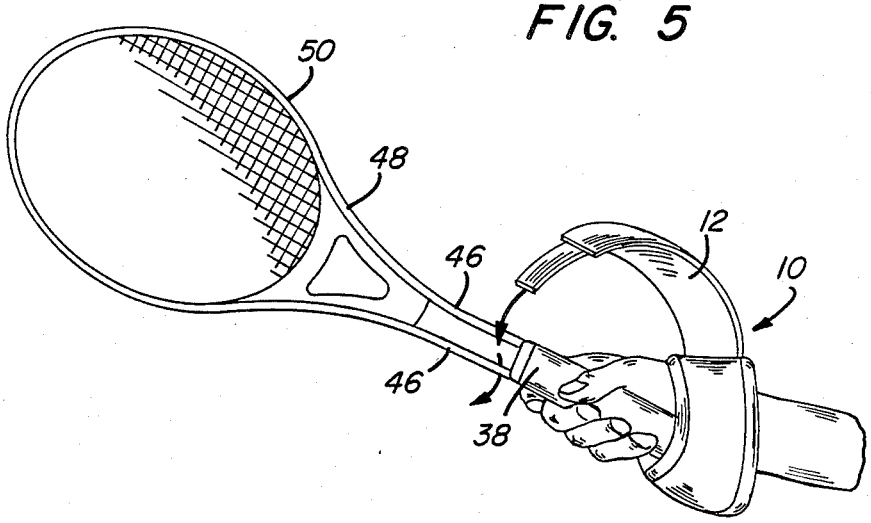
FIG. 5 is a pictorial illustration in another mode of use.

Use of the accessory 10 is illustrated in FIG. 4 wherein the loop end 18 encompasses the butt end 36 of a handle portion 38 of a sports racket such as a tennis racket 40. The user then grips the racket handle 38 with his hand 42, preferably at a point above the butt end 36 such that a portion of the racket handle extends below the hand and generally adjacent the wrist 44. The webb 12 of accessory 10 then is wrapped repeatedly about the wrist 44 and adjacent butt end portion of the racket handle 38 to flexibly retain the racket handle 38 with respect to the wrist 44 of the user. As shown in FIGS. 4 and 5, the user of accessory 10 may grip the racket with either the right or the left hand.

The resiliency of the material of webb 12 in both the longitudinal and transverse directions permits the material of webb 12 to conform to the contours of the user's wrist and the racket handle upon wrapping thereof as above described. The resilient flexibility also imparts improved user comfort and prevents load concentrations on localized portions of the user's wrist. In other words, the resilient flexibility of the material promotes distribution of reaction loads over as much of the hand, wrist and forearm of the user as are encompassed by the wrappings of the material.

Of course, the benefit attainable by use of accessory 10 may be optimized by the individual user by varying the mode of wrapping in any of a variety of ways. For example, the webb 12 may be wrapped relatively looser or tighter by decreased or increased stretching thereof during wrapping to provide relatively looser or firmer support for the racket handle 38 with respect to wrist and arm of the user. Similarly, the individual wrappings of webb 12 may be generally aligned or alternatively may be spread lengthwise of the wrist area to encompass adjacent portions of the hand and forearm and thereby more widely distribute the loadings imparted to the user's arm upon impact of the racket head with a ball. Still further, the user may desire to "choke up" further than normal on the racket handle 38 to allow a greater proportionate length of the handle 38 to project adjacent his wrist and forearm, and the accessory 10 may be wrapped further up on the forearm to provide even greater leverage and wrist support to resist wrist movement during racket use.

The accessory 10 may also be utilized in conjunction with a longer than normal racket such as the Seiko TM Racket. With such a racket, the player may effectively "choke up" further than normal on the racket handle without sacrificing any of his normal length of reach. The additional length of handle extending below his grip may be utilized in conjunction with accessory 10 as described above to lengthen the expanse of the wrappings of accessory 10, or to displace the wrappings along the forearm of the user to provide yet another mode for optimizing power, control and manuverability.

The Velcro TM type fastener as above described permits continuous adjustment of wrapping tension and fitting requirements for the accessory 10 within a predeterminable range of adjustments. For any given user, the fitting requirements are mandated by a particular wrist size and racket handle diameter as well as the particular grip the user employs on the racket handle and his or her preferences regarding how tightly and over what extent of the hand, wrist and forearm the accessory 10 is to be wrapped.

Yet another mode of wrapping for accessory 10 is shown in FIG. 5 wherein the webb 12 is passed at least once, and conceivably multiple times, between the structural members 46 which project from the handle 38 to form the throat 48 and head 50 of the racket. The result is an even wider distribution of the tension forces imparted by the webb 12 for retention of the racket in the hand of the user, and more effective distribution of the available support for the reaction forces which would otherwise tend to bend or twist the user's wrist on ball impact with resultant loss of control.

For any mode of wrapping of accessory 10 as above described, the Velcro TM fastener provides a further element of support because it is flexible but non extensible and therefore provides additional support or stiffness as it encompasses the wrapped accessory 10 without binding the wrist. This combination of resilient flexibility in the wrappings of webb 12 combined with the stiffness of the encompassing Velcro® fastener band provides a further novel mode of support for retaining a racket handle with respect to the hand, wrist and forearm of a user. The cushioning effect provided by webb 12 offers enhanced comfort to the user in spite of the more rigid or stiff support afforded by the encompassing nonextensible fastener band.

The fastener band also serves to limit the available wrist movement and provides thereby further support for the wrist. That is the resiliently flexible webb 12 provides support by limiting wrist movement and cushioning the impact loads on the racket head that tend to bend or "break" the wrist. The fastener band, being non-extensible, limits wrist movement by supporting the impact loads, without further wrist movement, that would otherwise produce wrist movement beyond a predeterminable limit. The limit of wrist movement is determined by the degree of strength imparted to the windings of webb 12 during wrapping therefore about the wrist and racket handle, and by the tightness with which the fastener band is secured about the windings of webb 12.

The above description of the manner of use of accessory 10 also constitutes the description of the novel method of this invention.

According to the above description there is provided by the instant invention a novel and improved accessory which offers enhanced firmness and control in the wielding of any hand implement utilized for striking an object, most notably a tennis racket or other similar article used in a sports endeavor.

Of course, I have comtemplated various alternative and modified embodiments apart from the above description of a presently preferred embodiment of the invention. Such modified and alternative embodiments certainly would also occur to those skilled in the art, once apprised of my invention. Accordingly, it is my intent that the invention be construed as broadly as may be permitted by the scope of the claims appended hereto.

I claim:

1. In an accessory adapted for use by the user of a manual implement to enhance the manual grip of the user on the implement handle, the combination comprising:

an elongated webb of resiliently extensible material having a retention end portion adapted to be retained with respect to such an implement handle and a free end portion opposite said retention end portion;

a closed loop formed adjacent said retention end portion, said closed loop being resilently distendable to encompass and resiliently grip such an implement handle;

said closed loop comprising a first loop of said resiliently extensible material and a second loop of elastic material disposed within said first loop, said elastic material having a greater magnitude of resilient tension per unit of elastic elongation than said resiliently extensible material;

an elongated non-extensible band means affixed adjacent said free end portion of said webb of material and extending in longitudinal alignment therewith;

said elongated webb being adapted to be wrapped continuously in multiple turns and with a varying magnitude of resilient tension about such an implement handle and adjacent portions of the hand and wrist of such a user manually gripping such implement handle with said elongated band being wrapped in at least one turn about said multiple turns; and securing means associated with said non-extensible band for securing said non-extensible band in encompassing relationship about said multiple turns to provide flexible load bearing support of such an implement for manipulation thereof by such a user.

2. The combination as claimed in claim 1 wherein said inner loop is of a size to be received in encompassing engagement on such an implement handle only in a resiliently distended condition.

3. The combination as claimed in claim 1 wherein said securing means includes an elongated portion of said band of sufficient length to encompass such multiple turns of said webb of material at least once.

4. The combination as claimed in claim 3, wherein said securing means is a continuously adjustable, selectively releasable securing means.

5. The combination as claimed in claim 4 wherein said securing means includes respective mating portions of a hook and loop fastener strip means.

6. The combination as claimed in claim 5 wherein said respective hook and loop portions are secured together in partially overlapping relationship to form said non-extensible band.

7. The combination as claimed in claim 6 wherein said webb is an expanse of resiliently distensible woven or knitted fabric.

8. The combination as claimed in claim 7 wherein said webb includes at least two layers of said fabric.

9. The combination as claimed in claim 8 wherein confronting surfaces of said fabric are adhered together by an adhesive bonding agent.

* * * * *